US005891310A

United States Patent [19]

Nelsen

[11] Patent Number: 5,891,310

[45] Date of Patent: Apr. 6, 1999

[54] DELAYED COKING CYCLE TIME REDUCTION

[75] Inventor: David K. Nelsen, Ponca City, Okla.

[73] Assignee: Conoco Inc., Ponca City, Okla.

[21] Appl. No.: 879,573

[22] Filed: Jun. 20, 1997

[51] Int. Cl.[6] ..... C10B 29/04; C10B 17/00

[52] U.S. Cl. ..... 201/10; 201/41; 202/84; 202/99; 202/221; 202/262; 202/268; 208/131; 208/132

[58] Field of Search ..... 201/10, 41; 202/99, 202/84, 215, 221, 262, 268; 208/131, 132; 196/104

[56] References Cited

U.S. PATENT DOCUMENTS

| | | | |
|---|---|---|---|
| 4,634,500 | 1/1987 | Elliott et al. | 201/39 |
| 5,076,895 | 12/1991 | Greenfield et al. | 203/10 |
| 5,083,374 | 1/1992 | Miller | 29/895.3 |
| 5,804,038 | 9/1998 | Nelsen | 201/39 |

*Primary Examiner*—Bekir L. Yildirim

[57] ABSTRACT

The cycle time for a delayed coker unit is reduced by externally heating the coke drum near the junction of the drum shell and the supporting skirt thereof prior to beginning the hot coker feed fill step. This reduces the thermal stresses at the area around the welds of the drum skirt.

7 Claims, 3 Drawing Sheets

COKE DRUM SCHEDULE
18 HOUR CYCLE

| TIME (HRS) | DRUM 1 | DRUM 2 | TIME (HRS) |
|---|---|---|---|
| 18 | COKE FILL | STEAMOUT | 1 |
| | | QUENCH | 4 |
| | | DRAIN | 1.5 |
| | | UNHEAD/PILOT HOLE | 1 |
| | | DRILL | 4.5 |
| | | REDHEAD | 0.5 |
| | | WARM-UP TEST | 5.5 |
| 1 | STEAMOUT | COKE FILL | 18 |
| 4 | QUENCH | | |
| 1.5 | DRAIN | | |
| 1 | UNHEAD/PILOT HOLE | | |
| 4.5 | DRILL | | |
| 0.5 | REDHEAD | | |
| 5.5 | WARM-UP TEST | | |

FIG. 2

DELAYED COKING CYCLE TIME REDUCTION

BACKGROUND OF THE INVENTION

1. Field of the Invention

This invention relates to delayed coking, and more particularly to a method of increasing the capacity of a delayed coker unit by reducing the cycle time of the unit.

In a typical delayed coker unit, a pair of coke drums are alternately filled and emptied, with coker feed being pumped into one of the drums while the other drum is being emptied of coke and prepared for the next filling cycle. The capacity of a delayed coker is determined by several factors including the size of the coke drums, furnace capacity, pumping capacity, and the cycle time. As the drum size, furnace and pumping capacity are not easily changed, sometimes the only feasible way to increase coker capacity is to reduce the cycle time, thereby allowing more drum fills in a given time period.

2. Background Art

A conventional coking operation includes, in the process of emptying the filled drum, the steps of steaming out the filled drum to remove residual volatile material from the drum, quenching the steamed out coke bed with water, draining quench water from the drum, opening the top and bottom of the coke drum (unheading the drum), drilling a pilot hole in the coke bed from the top, drilling out the remaining coke with a radially directed jet drill, removing the drilled out coke from the bottom of the drum, closing the top and bottom openings of the coke drum, and preheating the empty coke drum by passing hot vapors from the other drum being filled with hot coker feed. The preheating step is necessary to bring the empty coke drum temperature up prior to switching the hot coker feed to the recently emptied drum, as otherwise the thermal stresses from feeding hot feed into a relatively cool drum would cause serious damage.

When capacity is not a problem, the preheat step can take place over a considerable time period, and the thermal stresses are manageable. When capacity becomes an issue, one way to increase it is by reducing cycle time, enabling production of more drums of coke in a given time period.

The preheat step discussed above is a significant part of the cycle time, and is the area that holds the most potential for cycle time reduction, as many of the other steps in the cycle are more or less fixed, or in any event not easily reduced without significant capital requirements.

A typical coke drum is supported by a skirt which is welded to the drum near the junction of the drum shell and the lower cone of the drum. The maximum thermal stresses occur at the time the hot oil feed, at about 900° F., is switched to the preheated drum. These thermal stresses are partly due to the fact that the interior surface of the preheated drum is hotter than the exterior of the drum, including the area where the supporting skirt is welded to the drum shell. The expansion rate of the interior of the shell, upon being contacted with hot oil feed, is initially greater than the expansion rate of the cooler exterior portion. If sufficient time is available, the preheat step can be carried out over a time period sufficient to heat the drum exterior to a temperature near that of the drum interior. However, this is a problem if preheat time is to be minimized in order to reduce the overall cycle time. There has been a continuing need for a method of reducing cycle time without exacerbating the thermal stresses in the drum, particularly in the area near the junction of the drum and its supporting skirt.

SUMMARY OF THE INVENTION

According to the present invention, the capacity of a coker unit is increased by reducing the cycle time for the alternate filling and emptying of a pair of coke drums. The cycle time reduction is accomplished by, during and/or just prior to directing preheat vapors to the interior of the drum, externally heating the coke drum in the area where the drum skirt joins the drum. This external heating brings the external drum temperature up to a level closer to the temperature of the preheated drum interior, and reduces the thermal stresses created when hot oil feed is introduced into the drum. With the use of external heat, the temperature of the drum from interior to exterior is more uniform, and the time required for drum preheat is substantially reduced since the hot oil feed can be started earlier. The overall cycle time is correspondingly reduced.

DESCRIPTION OF THE DRAWINGS

FIG. 2 is a chart showing the coke drum schedule for a coking cycle.

DESCRIPTION OF THE PREFERRED EMBODIMENTS

The primary object of the present invention is to increase the capacity of a coking facility without having to increase the size of the process equipment. This can be accomplished, up to a point, by increasing the fill rate of the coke drum in which coke is being formed. However, the cycle time, or time during which feed is entering the drum, cannot be reduced to less than the amount of time required to remove the coke from the other drum. The coke removal process includes a time for steamout, quench, draining of quench water, drilling a pilot hole, drilling out the coke from the drum, and warming up the drum in preparation for the next fill cycle. Some of these steps have minimum amounts of time below which it is not practical to go. Once these minimum times are reached, the cycle time, and the coker capacity, are more or less fixed.

The target of this invention is the preheat step. This step takes up a considerable portion of the cycle. In the preheat step, the coke drum has been emptied, and the top and bottom heads of the drum have been reattached. The drum is purged with steam and tested for leaks. Hot vapor from the drum being filled is then diverted into the cool empty drum to preheat the empty drum prior to switching drums and directing hot feed into the empty drum.

Figure 1:
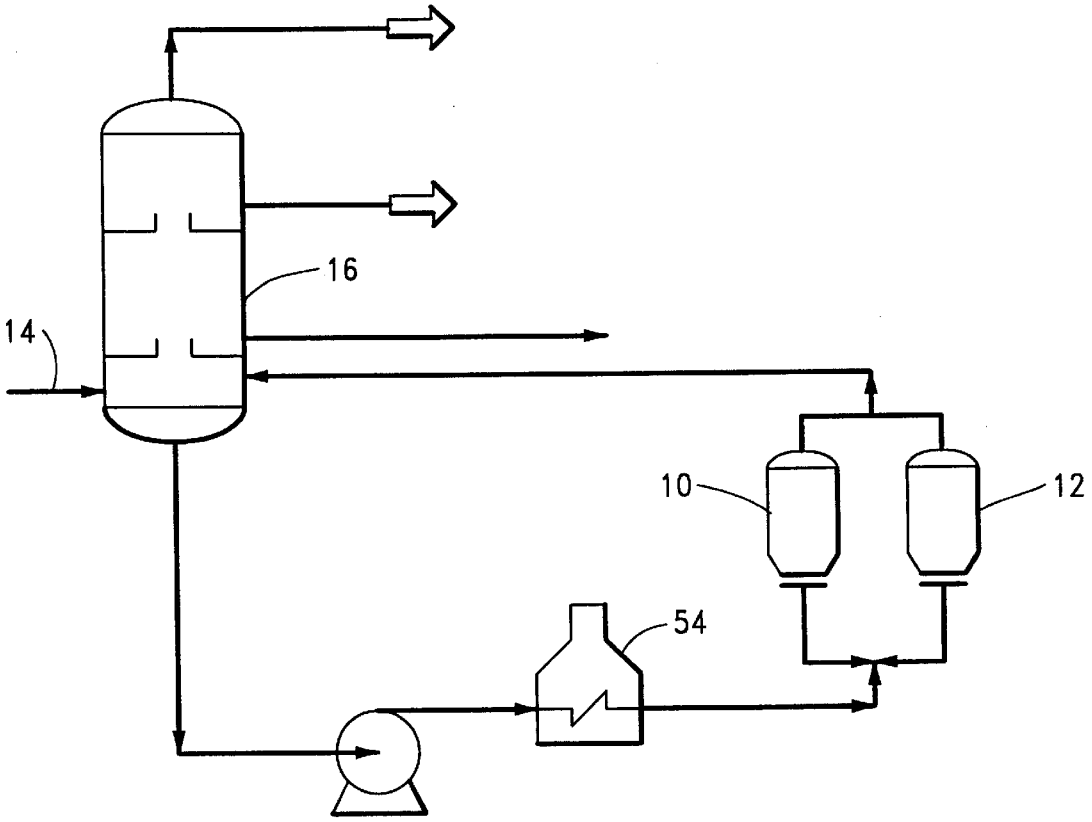
FIG. 1 is a schematic view of a delayed coker unit showing a pair of coke drums and associated equipment.

FIG. 1 shows a typical coker unit comprised of a pair of coke drums 10 and 12. Coker feed from feed line 14 enters coker fractionator 16 and is pumped to furnace 54 and then fed to one of the coke drums. Overhead vapors from the drum being filled return to fractionator 16 where they are separated into product streams. The preheat step for the drum not being filled with coker feed is accomplished by diverting (by means of valving not shown) a portion of the overhead vapors from the on-line drum back to the top of the off-line drum. In accordance with this invention, external heat is applied to the area of the drum-to-skirt connection during and/or prior to passing hot preheat vapors through the off-line drum, and prior to introducing hot oil feed into the drum.

By applying external heat to the drum at the area of the drum-to-skirt junction during and/or prior to passing preheat vapor through the drum, the temperature at the critical area of the drum-to-skirt welds is more uniform at the time hot oil feed is introduced into the drum, and the preheat time can accordingly be reduced without setting up the potential for damaging thermal stresses at the time of hot feed introduction.

Figure 3:
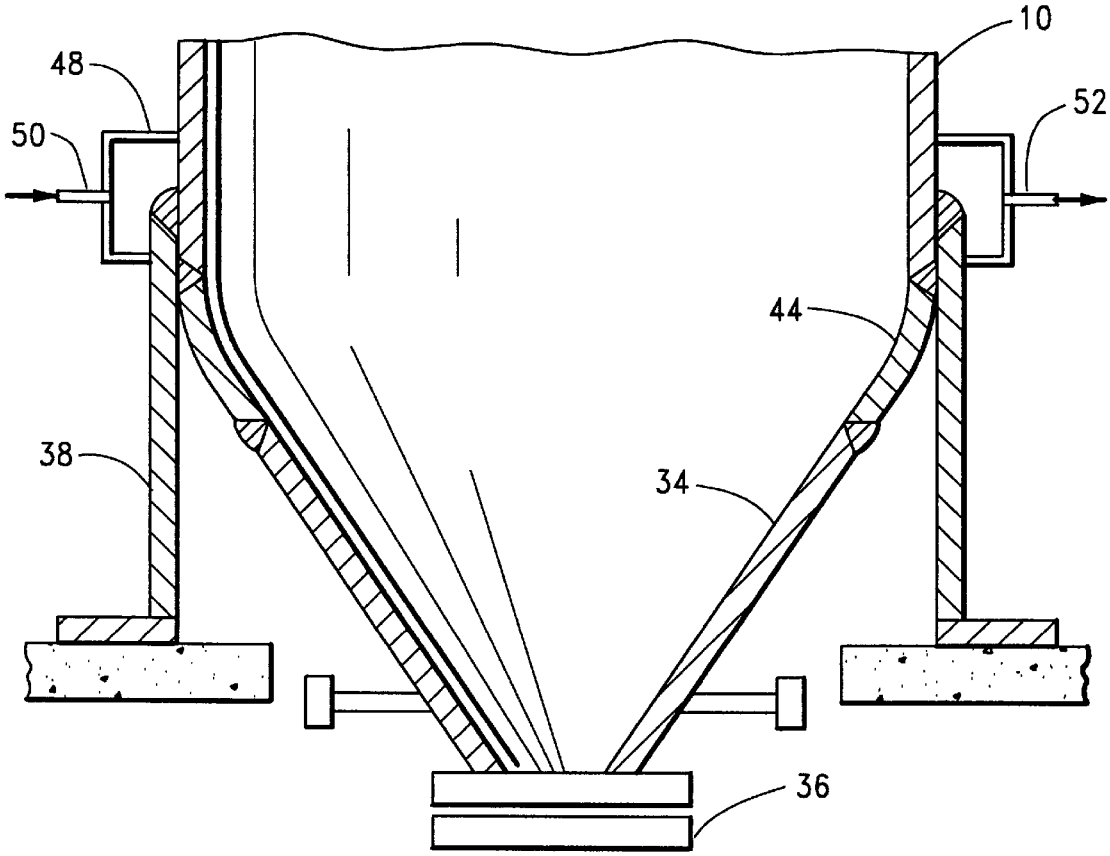
FIG. 3 is a side elevation, partly in cross section, showing details of a coke drum and its supporting structure.

The means for applying external preheat to the drum are best shown in FIG. 3. A steam jacket 48 encircles drum 10 around the area of the skirt-to-drum junction. A heating fluid inlet 50 and outlet 52 are provided for passing preheat fluid, preferably steam or hot process gas such as flue gas, through the steam jacket 48. Alternatively, the external preheat could be provided by an electrical heating band or the like.

Referring to FIG. 2, a typical cycle schedule is shown. The example illustrated is for an eighteen hour cycle, but longer and shorter cycles are common. In the illustrated cycle, 5.5 hours are allowed for warm-up and testing. The warm-up or preheat portion can be reduced by the process of the invention without the increased thermal stresses that would occur in the absence of the external preheat of the invention.

Figure 6:
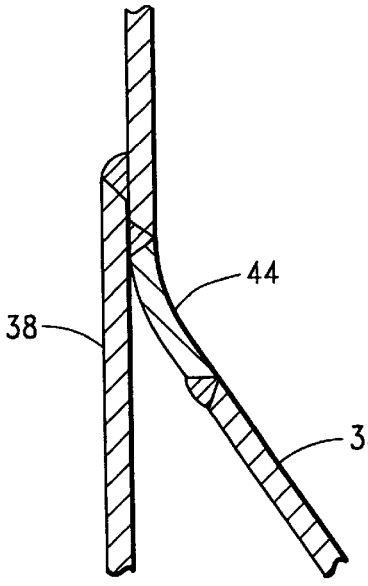
FIG. 6 is a cross section showing a coke drum supported by a skirt welded to the shell of the drum.

As seen in FIG. 3, a coke drum 10 includes a bottom cone section 34 and a removable lower plate 36. Between the drum shell and the bottom cone section 34 there is a transition or knuckle section 44. As shown in FIGS. 3 and 6, near the junction of the drum shell and knuckle section 44, a supporting skirt 38 is welded to the drum, in what is sometimes referred to as a tangent line connection.

Figure 5:
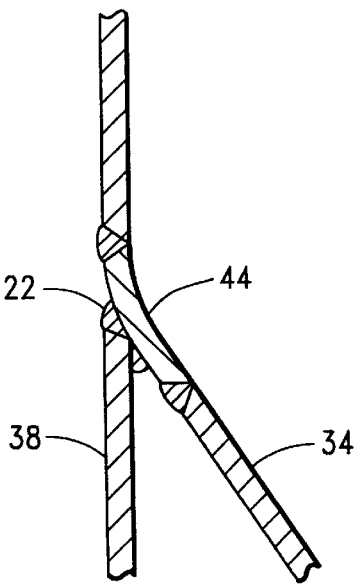
FIG. 5 is a cross section showing a coke drum supported by a skirt welded to the knuckle section of the drum.

As shown in FIG. 5, a knuckle section 44 is welded between the drum shell and lower cone section 34. A supporting skirt 38 is welded to the knuckle section 44 at weld 22, in what is sometimes referred to as a knuckle connection.

Figure 4:
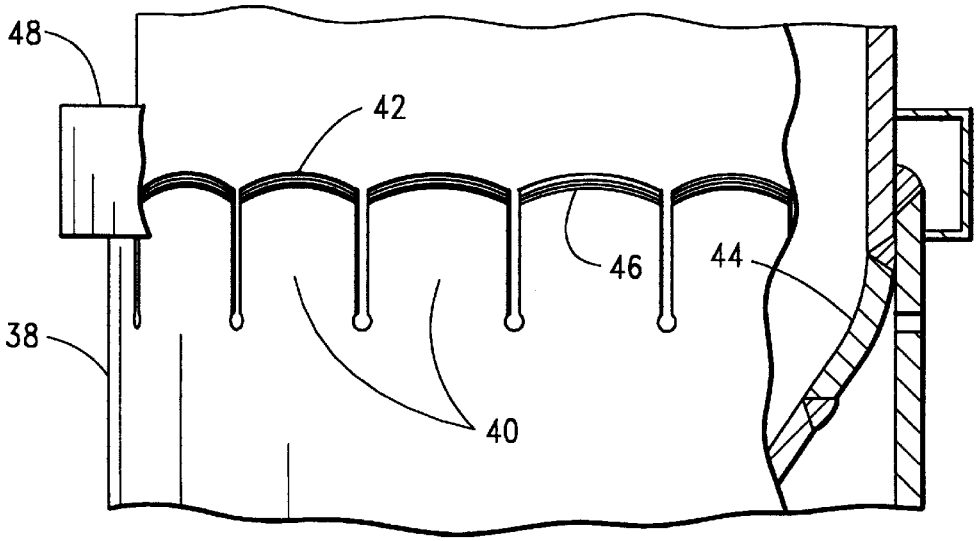
FIG. 4 is a side elevation, partially cut away, showing details of the junction of a coke drum and its supporting skirt.

In one popular variation as shown in FIG. 4, the skirt includes a series of fingers 40 formed by slots extending from the top of the skirt, and each finger has a curved top 46 to present a scalloped shape, and the curved finger tops are welded to the drum shell. It is common to include rounded lower ends in slots in the skirt to prevent stress risers from forming at the slot ends. In cases where the steam jacket 48 extends over part of the slots extending from the top of the skirt as shown in FIG. 4, it may be desirable to apply a packing material in the slots to prevent leakage of heating fluid.

Whichever type of skirt-to-drum system is used, the junction between the drum shell and skirt is fairly cool when the drum preheat step is started. Drum preheat is normally provided by diverting part of the overhead vapors from the filling drum to the top of the recently emptied drum. These vapors are very hot, and rapidly heat the interior surface of the drum. The exterior drum surface, and especially the welded junction of the drum shell and the supporting skirt, does not heat up at the same rate as the interior of the drum. High thermal stresses then develop because of the thermal shock that occurs when hot oil feed is introduced into the bottom of the drum. This thermal shock can potentially damage the skirt-to-drum connection.

To illustrate the process of the invention, the coking cycle including the use of external drum preheat will now be described with reference to FIGS. 1 and 3.

Hot coker feed from furnace 54 is fed to the bottom of coke drum 10. At the time feed to drum 10 is initiated, coke drum 12, which is full of coke, is steamed with low pressure steam to strip residual volatile hydrocarbons from the coke bed in the drum. The steam also removes some heat from the coke. After the steamout step, the coke is quenched by filling the drum with quench water. Once the coke bed is covered with water, the drum drain is opened and water is drained out. The top and bottom drum head covers are then removed. A pilot hole is drilled through the coke bed from the top, and then a rotating high pressure jet drill passing down through the pilot hole directs a cutting stream horizontally against the coke bed. The drilled out coke falls downwardly out of the drum. After the coke cutting is completed and the coke has been removed from the drum, the head covers are reinstalled and the drum is purged with steam and tested for leaks. Part of the hot vapor from the top of the on-line drum is diverted into the cleaned drum to warm the drum to a predetermined temperature. Hot feed from furnace 54 is then switched into the cleaned drum.

The essence of the invention is in externally applying heat to the junction of the coke drum and its supporting skirt during and/or prior to putting the hot preheat vapors through the drum, and prior to introducing hot oil feed into the drum. Preferably, the application of external heat begins after the drilling jet is below the level of the drum-to-skirt junction. The application of external heat allows the area of the drum-to-skirt junction to more nearly approach the temperature of the drum interior during the preheat step, and allows the earlier introduction of hot oil feed without the damaging thermal stresses that would result if the exterior of the drum, particularly around the drum-to-skirt welds, is at a much lower temperature than the interior of the preheated drum. As a result of the application of external heat, the warm-up time can be reduced, resulting in an overall reduced cycle time, with resulting increased production rate for the coking unit.

The foregoing description of the preferred embodiments of the invention is intended to be illustrative rather than limiting of the scope of the invention, which is to be defined by the appended claims.

I claim:

1. In a delayed coking process in which a pair of coke drums each supported by a skirt section welded to said drum are alternately filled and emptied, and in which the emptying portion of the cycle comprises the steps of:

(a) steaming out the filled coke drum to remove residual volatile matter from the drum;

(b) quenching the hot coke bed with water;

(c) draining quench water from the coke drum;

(d) opening the top of the coke drum and drilling a pilot hole through the coke bed therein;

(e) drilling out the coke from the coke bed between the pilot hole and the coke drum wall by radially directed drill water and removing the coke through an opening in the bottom of the coke drum;

(f) closing the top and bottom openings of the coke drum; and (g) prior to introducing feed into the emptied drum, preheating the empty drum by passing hot coke drum vapors through the drum;

the improvement wherein the thermal stresses at the junction of the coke drum and skirt are reduced by applying heat to the exterior portion of said coke drum adjacent the junction of the drum shell and the skirt of said drum prior to introducing hot feed oil into said drum, thereby preventing excessive thermal stresses.

2. The process of claim 1 wherein heat is applied to the exterior of said drum by utilizing a steam jacket surrounding said drum near the junction of the shell and the supporting skirt thereof.

3. The process of claim 1 wherein heat is applied to the exterior of said drum by utilizing an electrical heating band surrounding said drum near the junction of the shell and the supporting skirt thereof.

4. The process of claim 1 wherein said heat applied to the exterior of said drum is initiated after the drill water is hitting the interior wall of the drum below the junction of the drum shell and its supporting skirt.

5. In a delayed coker facility comprised of a coker fractionator, a coker furnace and a pair of coke drums each supported by an attached supporting skirt, the improvement wherein each of said coke drums includes means affixed thereto for externally applying heat at the juncture of said coke drum and its supporting skirt.

6. The delayed coker facility of claim 5 wherein said means for externally applying heat comprises a steam jacket surrounding the juncture of said coke drum and its supporting skirt.

7. A method for increasing the capacity of a coker unit by reducing the cycle time for the alternate filling and emptying of coke drums, wherein cycle time reduction is carried out by externally heating the coke drum in the area where the coke drum is attached to a supporting skirt section during, just prior to, or both prior to and during, the introduction of coking preheated vapors to the interior of the coke drum, comprising reducing the thermal stresses between the coke drum and the attached supporting skirt section by providing a more uniform temperature between said coke drum and said supporting skirt using said external heating, and thereby reducing coke drum preheat time and thereby reducing overall delayed coking cycle time.

* * * * *